US005501649A

United States Patent [19]

Queppet

[11] Patent Number: 5,501,649

[45] Date of Patent: Mar. 26, 1996

[54] MARTIAL ARTS TRAINING PAD AND BLOCKING SHIELD

[76] Inventor: Timothy J. Queppet, 117 Railroad Ave., Unit A1, West Grove, Pa. 19390

[21] Appl. No.: 329,415

[22] Filed: Oct. 27, 1994

[51] Int. Cl.[6] ..... A63B 69/26

[52] U.S. Cl. ..... 482/88; 434/247; 482/86

[58] Field of Search ..... 434/247, 251; 482/88, 87, 86, 83; 273/55 A, 55 R, 57.3

[56] References Cited

U.S. PATENT DOCUMENTS

| | | | |
|---|---|---|---|
| 1,044,987 | 11/1912 | Campbell . | |
| 2,239,223 | 4/1941 | Gilman | 273/55 R |
| 2,526,217 | 10/1950 | Gilman | 273/55 |
| 3,062,547 | 11/1962 | Kopp | 434/251 X |
| 3,759,515 | 9/1973 | Crooks | 482/88 |
| 3,866,909 | 2/1975 | De Santis | 482/88 |
| 4,478,408 | 10/1984 | Bruckner | 272/76 |
| 4,546,966 | 10/1985 | Segura | 272/76 |
| 4,557,477 | 12/1985 | Clements et al. | 482/86 |
| 4,667,954 | 5/1987 | McCorkle | 272/76 |
| 4,807,302 | 2/1989 | Cannella | 2/16 |
| 4,942,624 | 7/1990 | Cho | 2/16 |
| 5,009,414 | 4/1991 | Bass | 272/76 |
| 5,209,691 | 5/1993 | Ekstein | 482/88 |
| 5,232,368 | 8/1993 | Morgia | 434/247 |

OTHER PUBLICATIONS

Advertisement for blocking/protective equipment from Blackbelt magazine. Jan. 1979 and Sep. 1969.

*Primary Examiner*—Jessica J. Harrison
*Assistant Examiner*—Michael O'Neill
*Attorney, Agent, or Firm*—Breneman, Georges & Krikelis

[57] ABSTRACT

The invention relates to a combination training pad and blocking shield for use in martial arts training. The pad and blocking shield is portable and has frontal and side strike zones which allow an athlete training in martial arts to spontaneously practice frontal and lateral kicks and punches on the shield while such shield is held by a partner as well as mid and high level attacks techniques, without concern for the safety of the partner.

9 Claims, 2 Drawing Sheets

Fig. 5
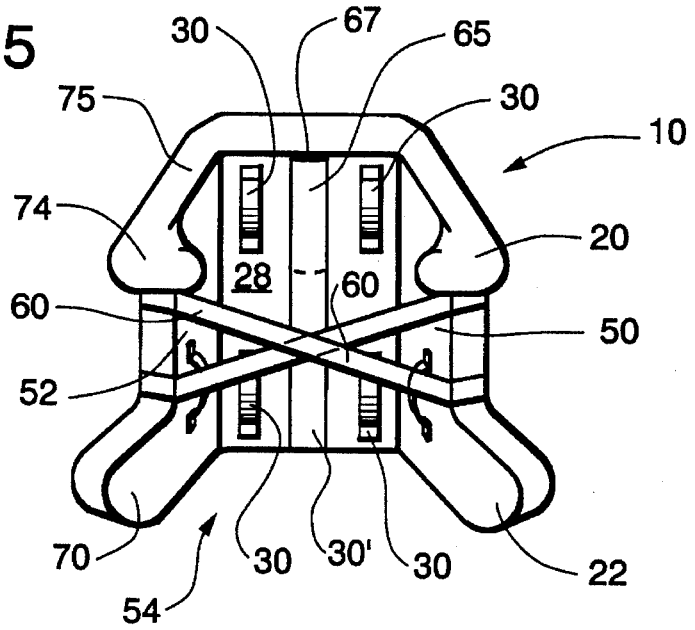
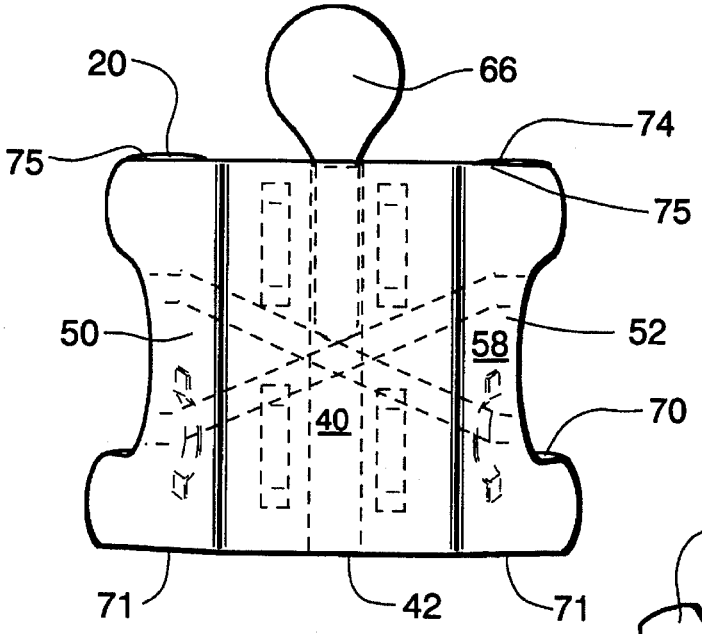
Fig. 6
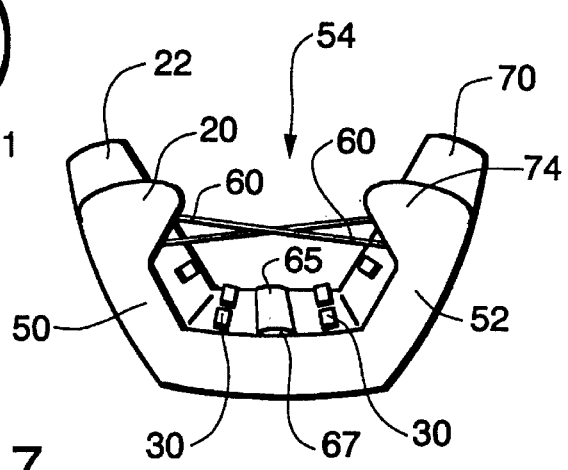
Fig. 7

MARTIAL ARTS TRAINING PAD AND BLOCKING SHIELD

BACKGROUND OF THE INVENTION

1. Field of the Invention

This invention relates to a sports implement and more particularly to a training and protection device for use by martial arts athletes to practice kicking and punching.

2. Description of Related Art

In order to effectively develop martial arts skills it is desirable to practice with a live partner, able to anticipate and parry the kicks and punches. It is also desirable that such kicks and punches be delivered with full force and speed so as to develop the appropriate muscles and muscle co-ordination in the training athlete. Martials arts athletes have used various pads and shields held by the live partner to protect such partner and to offer a convenient target for the training athlete to strike without fear that his or her blow will hurt such partner. Such pads or shields typically are shaped as a generally rectangular, round or oval pillow having a front strike surface and equipped with straps in the back surface for holding the pad in front of one's torso. In training, the partner watches the athlete and attempts to anticipate, and thus intercept, incoming kicks or punches with the pad so as to prevent being injured by the kicks or punches.

The problem with this approach is that the partner must anticipate the direction that the blows will be delivered, i.e., to the front or to the side, and then respond quickly and accurately to parry the blows. On the other hand, the athlete who is training must be confident in the ability of the partner to respond accurately and in time to prevent injury if he or she is to strike with all available speed and force. This is particularly significant when the "attacker" wants to practice launching "double strike" techniques to different target areas, and the shield holder proves too slow to fend quick combination strikes. In actuality, the athlete holds back or restrains his blows, for fear that the partner will not accurately aim the pad to timely parry the thrust and, as a result, does not train as effectively.

U.S. Pat. No. 5,232,368 teaches an improved martial arts shield which comprises a pillow like pad with wing like attachments extending forward of the shield which fall off when stricken by the training athlete. While this shield provides the athlete with a better defined strike zone for practicing his kicking and punching, it still presents the same disadvantages of the earlier simple pad shields, in that it has to be accurately guided by the partner to intercept an incoming blow.

Thus, there still is a need for a shield to be used in martial arts training which will allow an athlete to spontaneously practice without concern for the safety of a partner and will protect a partner during such a practice without requiring the partner to exhibit a great amount of skill in intercepting incoming blows.

It is an object of the present invention to provide a training pad to be used in martial arts in which an athlete can spontaneously practice a variety of frontal and lateral blows as well as high and mid attacks, by kicking an punching, to improve his martial arts skills.

Another object of the invention is to provide a blocking shield to be used in martial arts training in which a partner holding the shield for a training athlete is adequately protected from the spontaneous blows of the athlete without needing to quickly reposition the shield on his torso to parry a variety of blows.

It is yet another object of the invention to provide a combination blocking pad and training shield for use in martial arts which is portable and easy to hold and use.

These and other objects of the present invention will be clear from the following description.

SUMMARY OF THE INVENTION

In accordance with this invention there is provided a portable combination training pad and blocking shield for use by athletes in practicing martial arts kicking and punching techniques which a partner may hold in front of his body for protection and to provide strike surfaces for an athlete to strike while practicing kicking and punching, comprising:

a resilient strike board having an outside surface against which said kicking and punching is directed, and inside surfaces opposite said outside surface having shield holding handles, wherein the improvement comprises:

the resilient board having, a generally planar front strike surface, bound by an upper edge, a lower edge, a left edge and a right edge;

a left lateral side extending rearwardly from said left edge of said front surface, and having a left lateral strike surface; and, a right lateral side extending from said right edge of said front surface and having a right lateral strike surface, wherein the left lateral side and the right lateral side form an angle with said front strike surface and an interior space.

In an alternate embodiment there is provided a vertical paddle extending vertically above the top end of the shield and supported in a pocket on the shield to provide a high strike target.

BRIEF DESCRIPTION OF THE DRAWINGS

The invention can be more fully understood from the following description thereof in connection with the accompanying drawings described as follows.

FIG. 5 is a schematic perspective rear view of the second embodiment of the combination pad and shield showing a means for absorbing shock on a top of the left and right lateral sides, and showing a means for stabilizing the shield on a bottom of the left and right lateral sides.

FIG. 6 is a schematic perspective front view of the second embodiment of the combination pad and shield showing the outside surfaces for striking by the athlete.

FIG. 7 is a schematic perspective view of the top side of the second embodiment of the combination pad and shield.

DESCRIPTION OF THE PREFERRED EMBODIMENTS

Figure 1B:
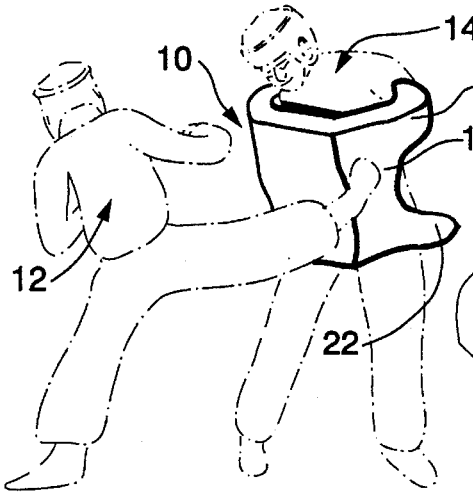
FIG. 1*b* is an illustrative view of the athlete kicking a lateral side strike surface of a second embodiment of the portable combination training pad and blocking shield of the present invention which is being held by the partner.

Throughout the following detailed description, similar reference characters refer to similar elements in all figures of the drawings. A training pad and blocking shield in accordance with the present invention hereinafter may be referred to simply as a shield.

Figure 1A:
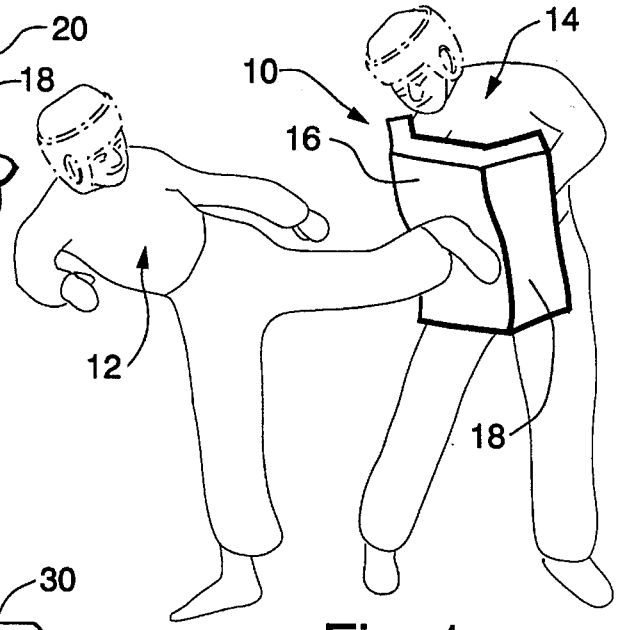
FIG. 1*a* is an illustrative view of an athlete kicking a front strike surface of a first embodiment of a portable combination training pad and blocking shield of the present invention which is being held by a partner.

Referring to FIGS. 1*a* and 1*b*, an athlete 12 training in martial arts techniques, such as kicks, is shown with a partner 14 who is holding a shield 10 in accordance with this invention. In FIG. 1*a*, the athlete 12 is kicking a front strike surface 16 of a first embodiment of shield 10, while the shield 10 is being held by the partner 14. In FIG. 1*b*, the athlete 12 is kicking a lateral side surface 18 of a second embodiment of the shield 10 while the shield 10 is being held by the partner 14. Both the first and second embodiments of the shield 10 protect the partner 14 from both frontal blows and lateral blows by the athlete 12, without the partner 14 needing to anticipate the moves of the athlete 12. In addition, the second embodiment of the shield 10 provides additional protection to the partner 14 with shock absorbing pads 20 and 74 and stabilizing pads 22 and 70 to be more fully described bellow in conjunction with the description of the second embodiment of the shield. The protection offered by the shield 10 to the partner 14 allows the athlete 12 to spontaneously practice all or essentially all martial arts techniques for kicking and striking freely without hesitancy in the action. Thus, the shield 10 of the present invention provides a combination blocking shield for the partner 14 and training pad for the athlete 12.

Figure 2:
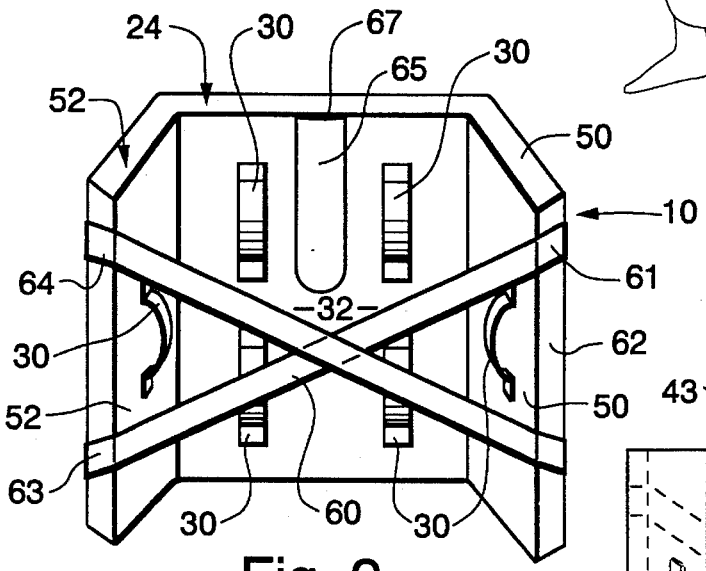
FIG. 2 is a schematic perspective rear view of the first embodiment of the combination training pad and blocking shield showing the inside surfaces with handles and a pocket, a left lateral side, and a right lateral side.
Figure 3:
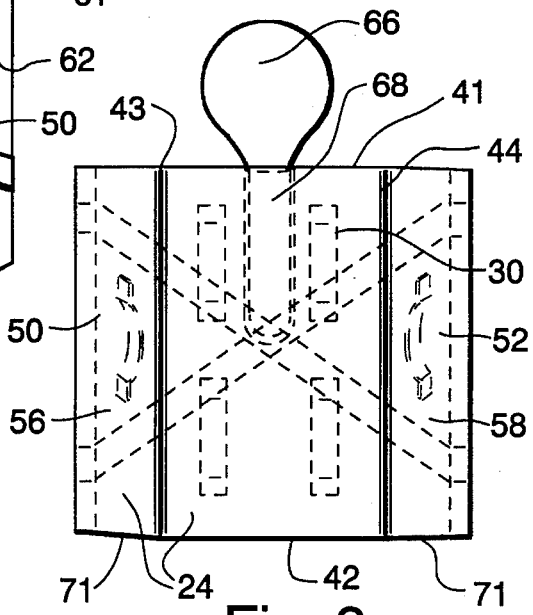
FIG. 3 is a schematic planar front view of the combination pad and shield showing the outside surfaces for striking by the athlete.
Figure 4:
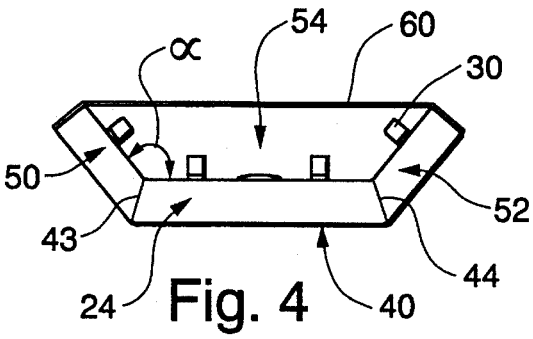
FIG. 4 is a schematic planar view of a top side of the combination pad and shield showing a strap.

Referring to FIGS. 2, 3, and 4, the shield 10 of the present invention has an outside surface for kicking and punching, and an inside surface opposite the outside surface. The shield is resilient to the force of the blows of kicking and punching applied by the athlete 12. The inside surface has at least one handle 30 for the partner 14 to hold the shield 10 from a rear side 32 in place in front of his body while such blows are applied. Preferably, the shield 10 has a multiplicity of handles 30 at various locations on the inside surface 28 so that the partner 14 can select the best or most appropriate of the handles 30 to hold to assure a firm grip on the shield 10 while in place protecting his body. The shield includes a front strike section and left and right lateral strike sides. The front strike section is a resilient front strike board 24 which has a front surface 40, an upper edge 41, a bottom edge 42, a left edge 43 and a right edge 44. The front surface 40 is generally planar for striking.

A left lateral strike side 50 extends from the left edge 43 of the strike board 24 and rearwardly from the front surface 40. A right lateral strike side 52 extends from the right edge 44 of the strike board 24 and rearwardly from the front surface 40. The left lateral side 50 and the right lateral side 52, each forms an angle $\alpha$ with the front surface 40 of the strike board 24 to create an interior space 54. Each of the left lateral side 50 and the right lateral side 52 have a left lateral strike surface 56 and right lateral strike surface 58 respectively. Thus, the shields front strike surface 40, the left lateral strike surface 56, and the right lateral strike surface 58 are continuously available for the athlete 12 to strike while practicing, without depending upon the ability of the partner 14 to place the shield in the proper position to parry the blows.

Preferably, the rear side of the shield includes one or more straps 60 extending across the rear side of the shield 10. The straps 60 have a first end 61 secured to an exterior edge 62 of the left lateral side 50 and a second end 63 secured to an exterior edge 64 of the right lateral side 52 of the shield 10. When the shield 10 is in place in front of the partner 14, the straps 60 rest upon the torso of the partner 14, while the hands and forearms extend into the interior space 54. Thus, the straps create a resilient buffer zone which helps absorb the shock of a blow before such shock reaches the athlete.

Optionally, as shown in FIG. 3, the inside surface of the shield 10 includes a pocket 65 for holding a strike paddle 66 or other similar types of conventional martial arts striking equipment in place on the shield 10. The pocket 65 has an opening 67 located near the upper edge 41 of the front inside surface of the shield 10, so that a handle 68 of a conventional strike paddle 66 can be inserted therein. The strike paddle 66 when placed in this position on the shield 10 simulates the position of a head of an opponent and thus provides the opportunity for the athlete 12 to practice blows to the head without injuring or contacting in any way the partner 14 holding the shield 10. In this instance the straps 60 also help keep the shield holder's face at a safe distance from the paddle to prevent injury.

Referring to FIGS. 5, 6 and 7 there is shown a second, preferred, embodiment of the shield 10 which includes stabilizing pads 22 and 70 which allow the shield to rest on the body of the partner 14 and shock absorbing pads 20 and 74 which help absorb the force of the blows. Both the stabilizing pads 22 and 70 and the shock absorbing pads 20 and 74, provide additional protection to the partner 14 and also assist in properly placing and keeping the shield 10 in front of the partner's body. The stabilizing pads 22 and 70 extend rearwardly from the lateral strike sides 50 and 52 along the bottom edge 71 thereof. The stabilizing pads are preferably thicker than the strike sides and extend into the interior space 54. The stabilizing pads make the shield easier to handle and to keep in the proper position, by allowing the shield to rest on the hips or lower torso of the partner 14.

The shock absorbing pads 20 and 74, also project rearwardly and form a cushion at a top edge 75 of each of the left and right lateral sides 50, and 52. The shock absorbing pads 20 and 74 also extend into the interior space 54 from the left and right lateral sides 50, 52 and taper to conform to the lateral sides 50, 52 of the shield 10. The greater cross-sectional width of the cushion is at or near the top edge 75 of the lateral sides 50, and 52 allows the shield 10 to rest against the upper torso or shoulders of the partner 14, and thus provide a means for absorbing shock 20 of the blows applied by the athlete 12. The means for absorbing shock 20 can also stabilize the shield 10 from movement, similar to that described for the stabilizing pads 22 and 70.

Optionally, as shown in FIG. 5, the inside surface of the shield 10 again includes a pocket 65 for holding a strike paddle 66 as discussed in conjunction with the description relating to FIG. 3. It is also possible to extend the pocket to the bottom of the front strike panel as shown in FIG. 5 to form an additional holding strap 30', by leaving a portion of the pocket unattached to the interior surface so that the partner 14 can insert his hand behind the pocket and simultaneously if so desired hold the paddle handle and the shield, or just the shield.

Materials suitable for the shield 10 include any that can withstand the impact force applied by kicking and punching blows to the shield 10 and can adequately protect the person holding the shield, i.e., the partner 14. It is desirable for the material to also be light enough for the partner 14 to easily hold and support the shield 10 for periods at a time. One material which is suitable is a lightweight cellular form resulting from introduction of gas bubbles during manufacture, i.e, expanded plastic or foam, an example of which is polyurethane foam. Particularly preferred is a dual density foam which has one layer of a high density foam, e.g., a cross-linked polyurethane foam, and a second layer adjacent to the first layer which is a low density foam, e.g., a polyurethane foam. The high density foam provides a resilient surface layer for striking. The low density foam provides a soft, cushioning layer to protect the person holding the shield 10. The foam layers are secured together by conventional means, such as glue, and are oriented in the shield such that the high density foam is the outside surfaces opposite the athlete 12 and the low density foam is the inside surface facing the partner 14.

It is preferred that the foam or dual density foam of the shield 10 be covered with a protective covering material such as, for example, leather, vinyl, or heavy duty canvas. Further the outside surfaces of the shield 10 may include markings or target areas to aid the training athlete 10 in directing blows to the front, left lateral and right lateral strike surfaces of the shield.

The shield 10 is formed by any conventional means such as extrusion molding. The front strike board 24, the left lateral side 50 and the right lateral side 52 can be formed as one piece of unitary structure to provide added strength to the shield 10. Further, the shock absorbing pads and the stabilizing pads can also be formed unitary with the shield 10. Alternately, the shock absorbing pads 20 and 74 and the stabilizing pads 22 and 74, can be separately formed and securely attached to the shield 10 by conventional means. It is desirable in this alternative case to include the pads within the covering on the shield 10 thus formed so that the shock absorbing and the stabilizing pads will resist a tendency to loosen from the shield 10 with repeated use of the shield over time.

Those skilled in the art having the benefit of the teachings of the present invention as hereinabove set forth, can effect numerous modifications thereto. These modifications are to be construed as being encompassed within the scope of the present invention as set forth in the appended claims.

I claim:

1. A portable combination training pad and blocking shield for use by athletes in practicing martial arts kicking and punching techniques which a partner may hold in front of his body for protection and to provide strike surfaces for an athlete to strike while practicing kicking and punching, comprising:

a resilient strike board having an outside surface against which said kicking and punching is directed, and inside surfaces opposite said outside surface having shield holding handles, wherein the improvement comprises:

the resilient board having, a generally planar front strike surface, bound by an upper edge, a lower edge, a left edge and a right edge;

a left lateral side extending rearwardly relative to said planar front surface toward said partner from said left edge of said front surface, and having a left lateral strike surface; and, a right lateral side extending rearwardly relative to said planar front surface toward said partner from said right edge of said front surface and having a right lateral strike surface, wherein the left lateral side and the right lateral side form an angle with said front strike surface and an interior space.

2. The portable combination training pad and blocking shield of claim 1 wherein the left lateral side has a bottom edge and the right lateral side has a bottom edge, and wherein the pad and shield further comprises left and right stabilizing pads also extending rearwardly relative to said planar front surface toward said partner from said left and right lateral sides adjacent said left and right bottom edge respectively.

3. The portable combination training pad and blocking shield of claim 2 wherein the stabilizing pads also extend into the interior space.

4. The portable combination training pad and blocking shield of claim 1 wherein the left lateral side has a top edge and the right lateral side has a top edge, and wherein the pad and shield further comprises a left and a right shock absorbing pad extending rearwardly relative to said planar front. Surface and inwardly toward said interior space from said left and right lateral sides adjacent said left and right top edge respectively.

5. The portable combination training pad and blocking shield of claim 4 wherein the shock absorbing pads also extend into the interior space.

6. The portable combination training pad and blocking shield of claim 1 further comprising a pocket on the inside surface of the front strike surface and a strike paddle in said pocket extending substantially vertically above the top edge of the shield.

7. The portable combination training pad and blocking shield of claim 1 wherein the left and right lateral sides each have a right and a left exterior edge respectively and, the pad and shield further comprising at least one strap extending across from the right exterior edge to the left exterior edge.

8. The portable combination training pad and blocking shield of claim 1 wherein the pad and shield is formed from a foam material.

9. The portable combination training pad and blocking shield of claim 1 wherein the pad and shield is covered with a protective material selected from the group consisting of leather, vinyl, and heavy-duty canvas.

* * * * *